United States Patent [19]

Teter

[11] 4,179,066

[45] Dec. 18, 1979

[54] MEANS FOR JOINING TOY TRACK SECTIONS

[75] Inventor: Edward C. Teter, East Aurora, N.Y.

[73] Assignee: The Quaker Oats Company, Chicago, Ill.

[21] Appl. No.: 876,741

[22] Filed: Feb. 10, 1978

[51] Int. Cl.[2] ..... A63H 19/30; A63H 18/02

[52] U.S. Cl. ..... 238/10 E; 104/147 A; 238/10 R; 238/10 F

[58] Field of Search ..... 238/10 R, 10 A, 10 B, 238/10 C, 10 E, 10 F; 104/53, 60, 147 A, DIG. 1; 46/1 R, 216; 273/86 R, 86 B

[56] References Cited

U.S. PATENT DOCUMENTS

| | | | |
|---|---|---|---|
| 2,711,857 | 6/1955 | Vanetzian et al. | 238/10 B |
| 4,066,211 | 1/1978 | Mak | 238/10 F |
| 4,082,220 | 4/1978 | Cheng et al. | 238/10 F |

FOREIGN PATENT DOCUMENTS

| | | | |
|---|---|---|---|
| 154129 | 6/1952 | Australia | 238/10 C |
| 639768 | 7/1950 | United Kingdom | 238/10 R |

*Primary Examiner*—Randolph A. Reese
*Attorney, Agent, or Firm*—Cumpston & Shaw

[57] ABSTRACT

A plurality of track sections in which each track section has end portions for interlocking with end portions of adjoining track sections to form an endless track for a toy train. Each end portion has longitudinally extending and laterally spaced apart projections and recesses extending into and receiving complementary recesses and projections respectively of a complementary end portion in an adjoining track section. The interacting projections and recesses automatically align the end portions laterally and horizontally, and prevent twisting of the track sections when interlocked or joined together. Each end portion further has a longitudinally extending flexible finger having a laterally extending rib on the end thereof which cooperates with a complementary longitudinally extending flexible finger and rib on an adjoining track section. Accordingly, when the end portions are pushed together, the ribs flex the fingers apart and then interlock under the pressure of the flexed fingers for releasably latching the track sections together.

6 Claims, 8 Drawing Figures

MEANS FOR JOINING TOY TRACK SECTIONS

BACKGROUND OF THE INVENTION

1. Field of the Invention

The invention relates generally to toy train tracks, and more particularly to track sections having improved joining means at the ends thereof for releasably securing adjoining track sections together.

2. Description of the Prior Art

It is known in the prior art, of which U.S. Pat. Nos. 1,142,150 and 2,207,171 are exemplary, to provide a toy train track in which the track sections are joined together. The joining means comprises pins extending longitudinally from the ends of the rails of one track section and insertable into complementary recesses in the ends of the rails of an adjoining section.

In U.S. Pat. No. 1,142,150, one of the end portions has a longitudinally extending projection of rectangular cross section insertable into a complementary recess in the adjoining track section. The latter projection further has an inclined spring finger which is cammed downwardly by a wall of the recess upon insertion of the projection into the recess. When the projection is fully inserted into the recess, the spring finger springs upwardly into a registering notch in the wall of the recess for releasably holding the track sections together.

In U.S. Pat. No. 2,207,171, one of the track sections has a cross tie provided with a slot having a wide end and a narrow end. The adjoining track section has a pivotal arm provided with a depending lip which is insertable through the wide end of the slot after the pins have been fully inserted into the recesses. The arm is then manually pivoted sliding the lip into the narrow end of the slot where the lip is held captive. The arm, lip and slot provide a latch for releasably latching the track sections in their interlocked or joined position.

One of the disadvantages of the joining means of U.S. Pat. Nos. 1,142,150 and 2,207,171 is that two separate manual operations have to be performed in order to separate the joined track sections. Firstly, the latch has to be released by depressing the spring finger in U.S. Pat. No. 1,142,150, or pivoting the arm in U.S. Pat. No. 2,207,171. Secondly, the two sections are pulled apart. A more serious disadvantage of the joining means of U.S. Pat. Nos. 1,142,150 and 2,207,171 is the sharp projections extending from the rails which can cause serious injury to children playing with the train track. This is particularly so if the track sections are carelessly swung around during play as young children are prone to do.

A further disadvantage of the joining means of U.S. Pat. Nos. 1,142,150 and 2,207,171 is that the pins have to be of a small diameter. Consequently, these pins are easily bent and broken under the rough handling they are normally subjected to.

U.S. Pat. No. 2,711,857 teaches a joining means for track sections in which one of the end portions of a track section has a pair of longitudinally extending flexible fingers defining a V-shaped slot terminating in a circular recess. The complementary adjoining end portion of a track section has a recess into which the flexible fingers are urged. A depending circular boss extending into the recess engages the inner surfaces of the flexible fingers and cams them outwardly as the boss passes through the V-shaped slot and nests in the circular recess. Upon nesting of the boss, the spring fingers return to their normal unflexed condition for releasably latching the track sections together.

A disadvantage of the joining means of all of the aforementioned prior art joining means is that such joining means can only be released by pulling the track sections apart. Accordingly, if turning, pivoting or bending forces are applied to the joined track sections by, for example, a child stepping or jumping on the joining means of the track sections, or manually turning, pivoting or bending the track sections as children are prone to do, portions of the track sections will break.

A toy auto raceway track is also known in which the joining means comprises longitudinally extending projections and recesses on one end portion of a track section insertable into complementary recesses and projections on the complementary end portion. The recesses have an inclined surface, at least some of which have a cam rib. When the end portions are pushed together, each cam rib cams a lip on the complementary projection into engagement with a flexible spring steel strip, and then enters a complementary notch in the projection. Each rib is held in its notch by the flexed spring strip for releasably securing the end portions together.

One disadvantage of the raceway track joining means is that the interacting complementary projections and recesses do not automatically align the track end portions in a horizontal direction. In addition, this prior art joining means does not resist separation when the track sections are twisted along their longitudinal axis, nor does it resist vertical shear at the joining means.

SUMMARY OF THE INVENTION

In accordance with a preferred embodiment of this invention, portable train track sections are disclosed which when joined together by the joining means of this invention forms an endless toy track for a train. Each of the track sections are of a unitary molded construction. The means for joining the track sections together comprise end portions of the sections. The end portions have longitudinally extending and laterally spaced apart projections and recesses extending into and receiving complementary recesses and projections respectively in adjoining track sections. The interacting projections and recesses prevent twisting of the track sections about their longitudinal axis when interlocked. The interacting recesses and projections further serve to automatically precisely align the interlocking end portions laterally and horizontally. Each of the end portions further has a longitudinally extending flexible finger having a laterally extending rib on the free end thereof. Each finger is defined by a pair of spaced apart, blind slots extending longitudinally from the end of the track section. The slots further vertically extend completely through each end portion in a direction transverse to the length of the track section. When the projections and recesses of the end portions of adjoining track sections are interlocked, the fingers are flexed outwardly by the interengaging ribs until they pass by one another. When this occurs, the fingers return toward their normal unflexed condition urging the ribs into interlocking engagement to form a latch for releasably holding the end portions of the track sections in their interlocked or joined position.

In a more specific aspect of the invention, each projection of the track section is provided with a cam surface engageable by a shoulder on each complementary recess of the adjoining track section for guiding the end portions of the track sections into interlocking engagement with one another. The interaction between the cam surfaces and shoulders further flexes the fingers of the adjoining track sections apart causing the ribs to move past one another. When this occurs, the flexed fingers return urging the ribs into their latched position.

One of the advantages of the joining means of this invention is that a single latch provides sufficient holding power to prevent casual separation of the track sections, yet permits ready separation of the track sections upon overloading of the joining means by a turning, pivoting or pulling force. This is achieved by providing a pair of interlocking, flexible elongated fingers and ribs of a thickness equal to the thickness of the bed of the track section. The thick, elongated fingers provide greater flexibility and holding power of the latch.

Another advantage of the joining means of this invention is that ready separation of the track sections upon application of an overloading force serves as a safety feature to prevent damage to the joining means. However, the joining means resists separation when subjected to a twisting or torsional force along a longitudinal axis and to vertical shear at the joining means. The resistance to vertical shear at the joining means is particularly desirable when the track sections are placed on a rug that permits relative vertical movement between the end portions.

Still another advantage of the joining means of this invention is that it is not necessary to hold one track section and release a latch with one hand, and to pull the track sections apart with the other hand to separate the sections. This is difficult to do for many younger children. All that is required to separate the joining means of this invention is the application by any means of a turning, bending or pulling force on the joining means in excess of the holding force of the latch.

The invention and its advantages will become more apparent from the detailed description of the preferred embodiment presented below.

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENT

Figure 1:
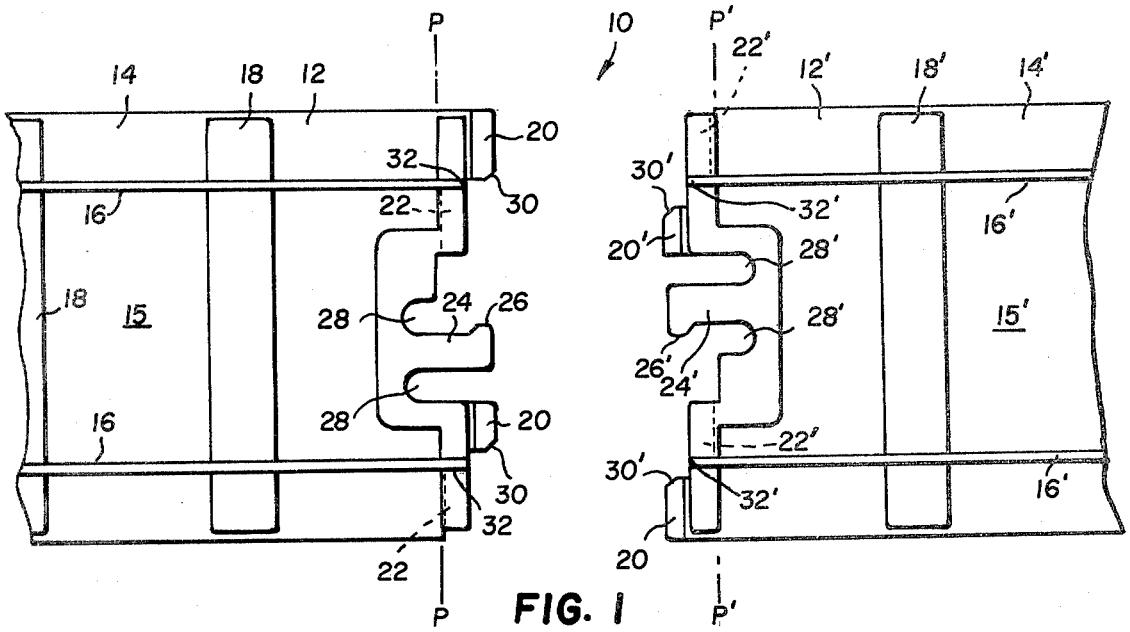
FIG. 1 is a top plan view of the joining means of segmental track sections in a separated, aligned position.
Figure 2:
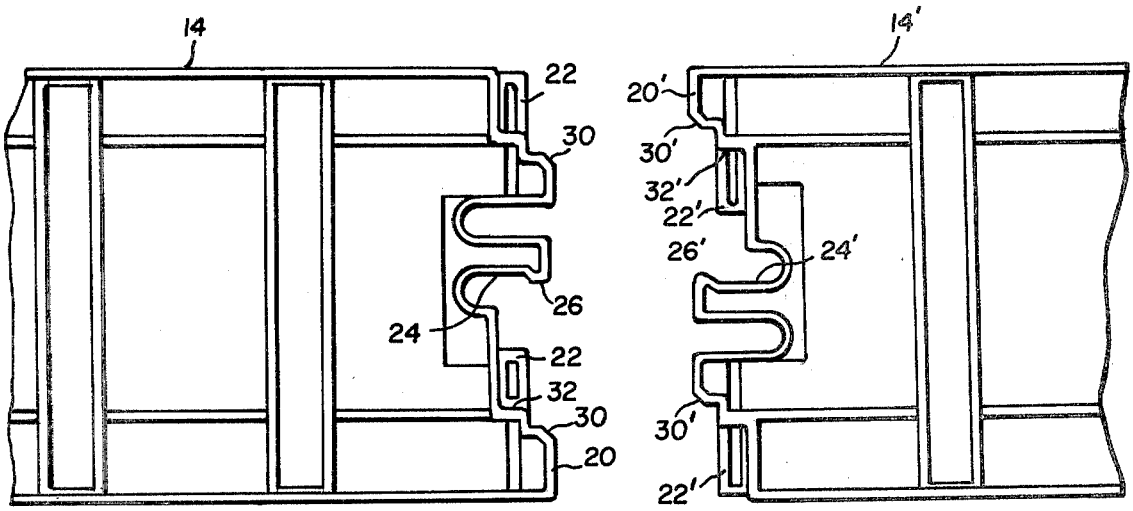
FIG. 2 is a bottom view of the joining means of FIG. 1.
Figure 3:
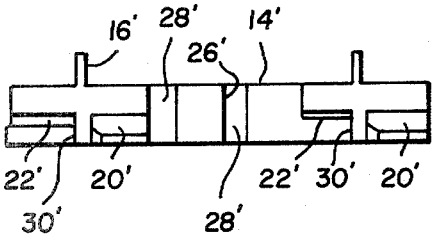
FIG. 3 is an end view of the end portion of the track section on the right.
Figure 4:
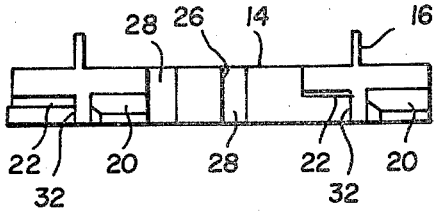
FIG. 4 is an end view of the end portion of the track section on the left.

With reference to FIGS. 1–4, a preferred embodiment of the joining means 10 of this invention is disclosed for interlocking or joining end portions 12, 12' of adjoining track sections 14, 14' to form an endless toy train track. Each track section 14, 14' is of a unitary molded construction and is formed of any suitable plastic material.

Each track section 14, 14' has a bed 15, 15' respectively, and a pair of parallel, spaced apart, longitudinally extending and vertically upstanding rails 16, 16' on the bed. Each bed further has laterally extending cross ties 18, 18'.

The joining means for joining track sections 14, 14' comprises end portions 12, 12' of beds 15, 15' respectively. The end portion 12 has longitudinally extending and laterally spaced apart projections 20 and recesses 22 extending into and receiving complementary recesses 22' and projections 20' respectively in the adjoining track section 12'.

The end portions 12, 12' further have longitudinally extending, flexible fingers 24, 24' respectively having laterally extending ribs 26, 26' respectively on the free ends thereof. Each finger 24, 24' is defined by a pair of spaced apart, blind slots 28, 28' extending longitudinally from the ends (represented by lines P, P' of the bed). The blind slots further extend vertically completely through the bed of each end portion 12, 12' respectively in a direction transverse to the length of the track section.

Figure 5:
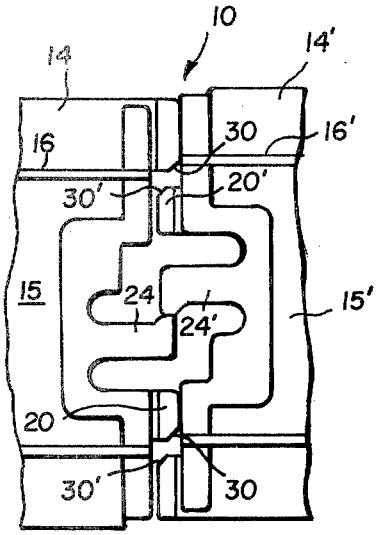
FIG. 5 is a top plan view of the joining means of segmental track sections when the end portions thereof are moved into engagement with one another.
Figure 6:
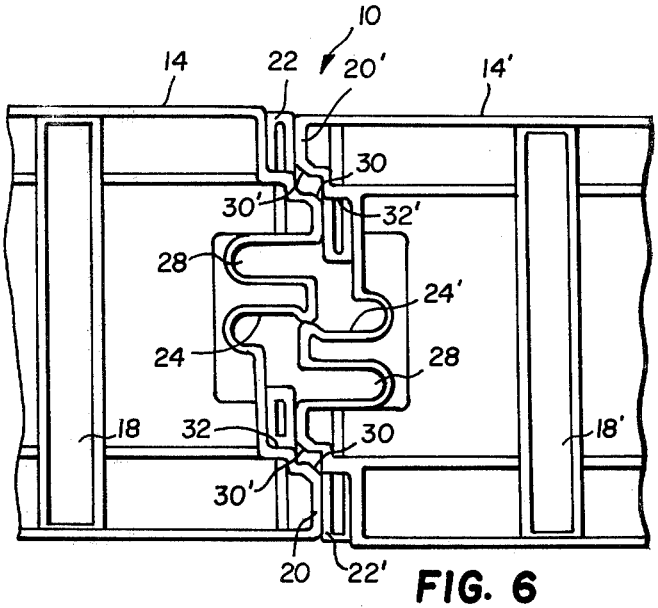
FIG. 6 is a bottom view of the joining means of FIG. 5.

Each of the projections 20, 20' further has a cam surface 30, 30' respectively which is engageable with shoulders 32, 32' respectively on each complementary recess 22, 22' respectively when the end portions 12, 12' are moved into engagement as seen in FIGS. 5 and 6. In this position, the ribs 26, 26' are also in face-to-face engagement causing the end portions 12, 12' to be slightly laterally displaced.

Figure 7:
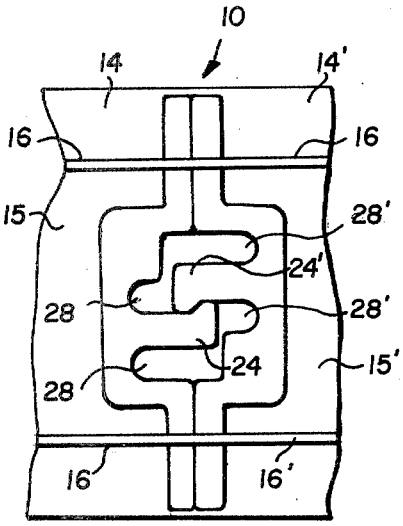
FIG. 7 is a top plan view of the joining means of segmental track sections when the end portions thereof are pushed together into an interlocked or joined position.
Figure 8:
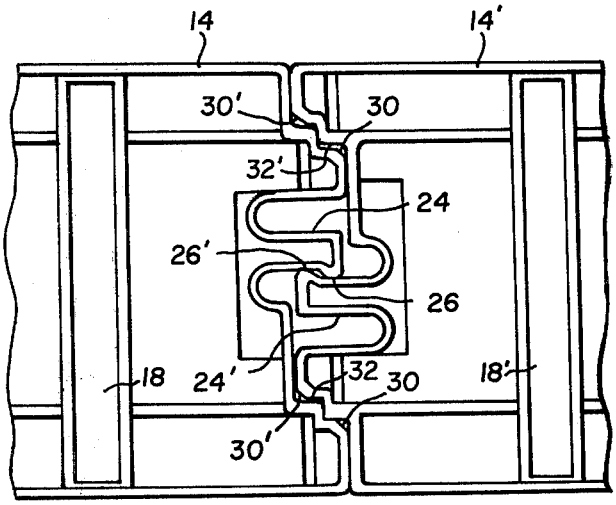
FIG. 8 is a bottom view of the joining means of FIG. 7.

When the end portions 12, 12' are pushed together as seen in FIGS. 7 and 8, the cam surfaces 30, 30' laterally guide the shoulders 32, 32' and hence the end portions 12, 12' into interlocking engagement. While this action is taking place, the ribs 26, 26' initially flex the fingers 24, 24' apart, and then move behind one another in latching engagement under the influence of the flexed fingers for releasably retaining both the flexed fingers and the end portions 12, 12' in their interlocked or joined position.

Due to the interaction between the projections 20, 20' and recesses 22, 22', the end portions 12, 12' are placed in exact lateral and vertical registry or alignment.

By virtue of the blind slots 28 28' the fingers 24, 24' are relatively long, and the fingers and ribs 26, 26' are of the same thickness as the beds 15, 15' respectively of the track sections. As a result of this design, the long fingers provide greater flexibility, and the large width or thickness of the ribs results in increased holding power of the latch.

Due to the thickness of the projections 20, 20' and fingers 24, 24', they are of extremely rugged construction and highly resistant to breakage due to rough handling received, for example, by children.

By virtue of the blind slots 28, 28', the free ends of fingers 24, 24' do not extend as far from the ends of the track sections 14, 14', represented by parting lines P, P', as do the projections 20, 20'. This, along with the increased thickness of the fingers, protects the fingers from damage or injury.

The invention has been described in detail with particular reference to a preferred embodiment, but it will be understood that variations and modifications can be effected within the spirit and scope of the invention as described hereinabove.

What is claimed is:

1. Joining means on end portions of an elongated molded toy track section for interlocking with end portions of adjoining track sections to form a track for a train, comprising:

a longitudinally extending first projection on each of said end portions of said track section insertable into a complimentary recess in an end portion of an adjoining track section;

a longitudinally extending first recess on each of said end portions laterally spaced from said first projection for receiving a complementary projection on the end portion of the adjoining track section; and a flexible latch member on each of said end portions having a free end part for engaging and retaining a free end part of a complementary flexible latch member on the end portion of the adjoining track section for releasably securing said track section to the adjoining track section, each of said latch members comprising a longitudinally extending flexible finger defined by a pair of laterally spaced apart, longitudinally extending blind slots extending from the end of each end portion for laterally spacing said finger from said first projection and first recess, said slots further extending completely through each of said end portions in a direction transverse to the length of said track section.

2. The joining means of claim 1, and further comprising a laterally extending rib on said free end part of each of said fingers, and a cam surface on said first projection of said track section engageable with a shoulder on a wall defining said complementary recess of the adjoining track section when said track sections are pushed together for laterally and longitudinally guiding the end portion of said track section into interlocking engagement with a complementary end portion of an adjoining track section, and for releasably securing each of said fingers of said track section to a complementary finger of an adjoining track section by flexing said fingers of said track sections apart causing said rib to move behind the complementary rib of the adjoining track section for latching said end portions of said track sections in a joined or interlocked position.

3. A unitary molded elongated track section having end portions which interlock with complementary end portions of adjoining track sections to form a track for a train, each of said end portions of said track section comprising:

a pair of longitudinally extending first projections insertable into complementary recesses in the end portions of a complementary interlocking track section;

a pair of first recesses laterally spaced from said projections for receiving complementary projections on said complementary interlocking end portion; and a flexible latch member on each of said end portions having a free end part for engaging and retaining a free end part of a complementary flexible latch member on the end portion of the complementary track section for releasably latching said track sections together, said latch members each including a longitudinally extending flexible finger interposed between one of said first recesses and one of said first projections of each of said end portions, each of said fingers being defined by a pair of laterally spaced apart, longitudinally extending blind slots extending from the end of each end portion for laterally spacing said finger from said one first recess and said one first projection, said blind slots further extending completely through said end portions in a direction transverse to the length of said track section.

4. The track section of claim 3, and further comprising a laterally extending rib on the free end part of each of said fingers, and a cam surface on each of said projections of said track section engageable with a complementary shoulder on a wall defining each complementary recess of the interlocking track section when the end portions of said track sections are pushed together for laterally and longitudinally guiding the end portions into interlocking engagement, and for releasably securing said latch member of said track section to the latch member of the complementary interlocking track section by flexing said fingers of said track sections apart causing said rib to move behind the complementary rib of the interlocking track section for latching said end portions of said track sections in a joined or interlocked position.

5. A toy train track section of unitary molded construction with end portions thereof interlocking with end portions of adjoining track sections to form an endless track for a train, each of said interlocked end portions or junctions comprising:

longitudinally extending and laterally spaced apart projections and recesses on one end portion extending into and receiving complementary recesses and projections respectively in the end portion of an adjoining track section for preventing twisting of said track sections when interlocked; and a flexible latch for releasably securing together adjoining track sections when the end portions thereof are pushed together, said latch comprising a longitudinally extending flexible finger on each of said end portions having a free end part for engaging and retaining a free end part of a complementary finger on an adjoining end portion, each of said fingers being defined by a pair of spaced apart, longitudinally extending blind slots extending from the end of each end portion for laterally spacing said finger from said projections and recesses, said blind slots further extending completely through each end portion in a direction transverse to the length of said track section whereby said finger interlocks with a complementary finger in the end portion of an adjoining track section when said projections and said recesses extend into and receive the complementary recesses and projections in the adjoining track section.

6. The track section of claim 5, and further comprising a laterally extending rib on said free end part of each of said fingers, and a cam surface on each of said projections of said track section engageable with a shoulder on each complementary recess of the complementary interlocking track section when the end portions of said track sections are pushed together for laterally and longitudinally guiding the end portions into interlocking engagement, and for releasably securing said latch member of said track section to the latch member of the complementary interlocking track section by flexing said fingers of said end portions of said track sections apart causing said rib to move behind the complementary rib of the interlocking track section for latching said end portions of said track sections in a joined or interlocked position.

* * * * *